US006535710B2

(12) United States Patent
Takeshima et al.

(10) Patent No.: US 6,535,710 B2
(45) Date of Patent: Mar. 18, 2003

(54) ELECTROPHOTOGRAPHY PHOTOSENSITIVE BODY

(75) Inventors: Motohiro Takeshima, Nagano (JP); Haruo Kawakami, Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 09/864,895

(22) Filed: May 24, 2001

(65) Prior Publication Data

US 2002/0018948 A1 Feb. 14, 2002

(30) Foreign Application Priority Data

May 25, 2000 (JP) ..... 2000-154307

(51) Int. Cl.[7] ..... G03G 15/08; G03G 13/06
(52) U.S. Cl. ..... 399/279; 399/159; 430/58.2
(58) Field of Search ..... 430/58.2, 96, 58.05; 399/147, 159, 279

(56) References Cited

U.S. PATENT DOCUMENTS 5,905,008 A * 5/1999 Yoshinaga et al. ..... 430/66
5,994,011 A * 11/1999 Kashimura ..... 430/58
6,033,817 A * 3/2000 Yusa et al. ..... 430/106.6
6,146,800 A * 11/2000 Yoshida et al. ..... 430/66
6,300,027 B1 * 10/2001 Chambers et al. ..... 430/66

FOREIGN PATENT DOCUMENTS

| | | | |
|---|---|---|---|
| JP | 06-167817 | 6/1994 | |
| JP | 08-190264 | 7/1996 | |
| JP | 09-026670 | 1/1997 | |
| JP | 11-065136 | 3/1999 | ..... G03G/5/05 |

* cited by examiner

*Primary Examiner*—John Goodrow
(74) *Attorney, Agent, or Firm*—Darby & Darby

(57) ABSTRACT

A function separated laminated electrophotography photosensitive body is equipped with at least a charge generating layer and a charge transport layer on top of a conductive substrate. A contact angle θ of pure water on the charge transport layer satisfies the equation θ>=94°. The resulting organic electrophotography photosensitive body prevents contamination of the photosensitive body surface resulting from component migration from the developing roller and achieves a stable image quality.

3 Claims, 1 Drawing Sheet

ELECTROPHOTOGRAPHY PHOTOSENSITIVE BODY

BACKGROUND OF THE INVENTION

The present invention relates to an electrophotography photosensitive body (henceforth, may be referred to as "photosensitive body") that can prevent contamination from a developing roller used in a printer having a non-magnetic single component developing system. Described in more detail, the present invention relates to an electrophotography photosensitive body concerned with improving the construction material of a charge transport layer that has organic material as the main component.

Electrophotography photosensitive bodies have a basic construction in which a photosensitive layer having a photoconductive function is layered on top of a conductive substrate. In recent years, there has been advances in research and development of organic electrophotosensitive bodies that use organic compounds as the functional component responsible for charge generation and transport. These have the advantages of having a variety of materials, high productivity and safety, and the like. Their applications for use in copiers and printers and the like have been advanced.

Currently, in printers, particularly low-speed printers, an inexpensive non-magnetic single-component developing system is used. They are manufactured for personal users or for office users. Furthermore, currently in the low speed printer market, although a monochrome system is still mainstream, demand for color printers using a non-magnetic single component developing system is growing. In the future, it is predicted that color printers will become mainstream.

Referring to FIG. 2, in non-magnetic single component developing systems, the outermost surface of the organic photosensitive layer of a photosensitive drum 6 and the outermost layer of a developing roller of a metal iron core 8 and a dielectric rubber material 7 are in contact. Toner 9, which is charged by the friction between toner 9 and the developing roller surface, adheres electrostatically to the developing roller surface. Toner 9 is made into a uniform thin layer by a metal blade 11. Toner 9 then has a bias voltage applied when it enters between photosensitive drum 6 and the developing roller. Toner 9 electrostatically adheres to the organic photosensitive body surface and is developed. Referring to the figure, there is also shown a printing paper 10.

The following are required qualities for the developing roller dielectric rubber used in the above non-magnetic single component developing system.

1) In order to have a suitable nip width, it must have a low hardness.
2) There is no permanent deformation with the deformation of the developing roller associated with contact.
3) In order to have the desired developing qualities, it should be in the semiconductor range of $10^5$–$10^{10}$ ohm cm.

For the properties of the developing roller surface and the area near the surface, 1) The desired charging polarity and charging amount is obtained by the friction generated with the toner.

2) Mold release with the toner is good, and there is no toner filming on top of the developing roller surface during use.
3) In order to have a uniform toner layer on top of the developing roller surface, the surface has a suitable surface roughness.
4) It has good abrasion resistance and has excellent durability.
5) With respect to the photosensitive body, there is no migration of components from the developing roller.

In order to have the desired developing roller quality, in addition to the rubber material, carbon black or white carbon ($SiO_2$) and the like can be added as electrical resistance adjusting materials in order to give the desired electrical qualities. In addition, plasticizer or hardening agents and the like can be added to adjust the rubber hardness. Various other materials such as vulcanizing agents, vulcanization accelerator agents and the like can be added.

As described above, by adding various additives other than rubber materials, the desired electrical resistance, mechanical properties, and surface properties for the developing roller can be achieved. However, with regard to the problem of component migration from developing roller to the photosensitive body surface as described in 5) of the developing roller surface properties, this is not just a problem with the developing roller surface but it is also a problem with the roller interior. While the photosensitive body and the developing roller are in contact, under the right conditions of temperature and humidity, particularly under a high temperature/high humidity environment, the components from the developing roller migrate, and these components adhere to the photosensitive body surface. When printing is conducted by a photosensitive body having these adhering components, the printed text can be deformed, or there can be image deterioration such as voids generated in black and halftone images.

OBJECT AND SUMMARY OF THE INVENTION

The object of the present invention is to solve the above problems and to prevent the contamination of the photosensitive body surface resulting from component migration from the developing roller. A further object is to provide an organic electrophotography photosensitive body that can achieve a stable image quality.

Intense study was conducted to solve the above problems. As a result, it was discovered the reason that the components from developing roller adhere to the photosensitive body surface (henceforth referred to as "volatile components") is because the high surface energy of the photosensitive body surface causes physical adhesion to occur.

In other words, the present invention is an electrophotography photosensitive body, being a function separated laminated electrophotography photosensitive body equipped with at least a charge generating layer and a charge transport layer on top of a conductive substrate and being used by mounting onto a printer of a non-magnetic single component developing system, wherein: a contact angle theta of pure water on the charge transport layer satisfies theta>=94 degrees.

In the present invention, the charge transport layer preferably contains a resin binder of only a polydialkyl siloxane-containing polycarbonate having a repeating unit represented by a following general formula (1)

(1)

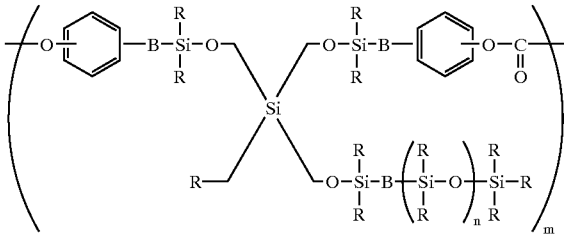

wherein each R is independently a $C_1$–$C_6$ alkyl group or an optionally substituted $C_6$–$C_{12}$ aromatic hydrocarbon group; B is $(CH_2)_x$; is an integer from 2–6; n is from 0–200; m from 1–50. Optionally, the charge transport layer can contain the polydialkyl siloxane-containing polycarbonate and another polycarbonate such that, with a weight M of the polydialkyl siloxane-containing polycarbonate and a weight N of the other polycarbonate is a ratio MIN which is greater than 1/4.

Even more preferably, the polydialkyl siloxane-containing polycarbonate has a repeating unit represented by a following formula (2), (2)

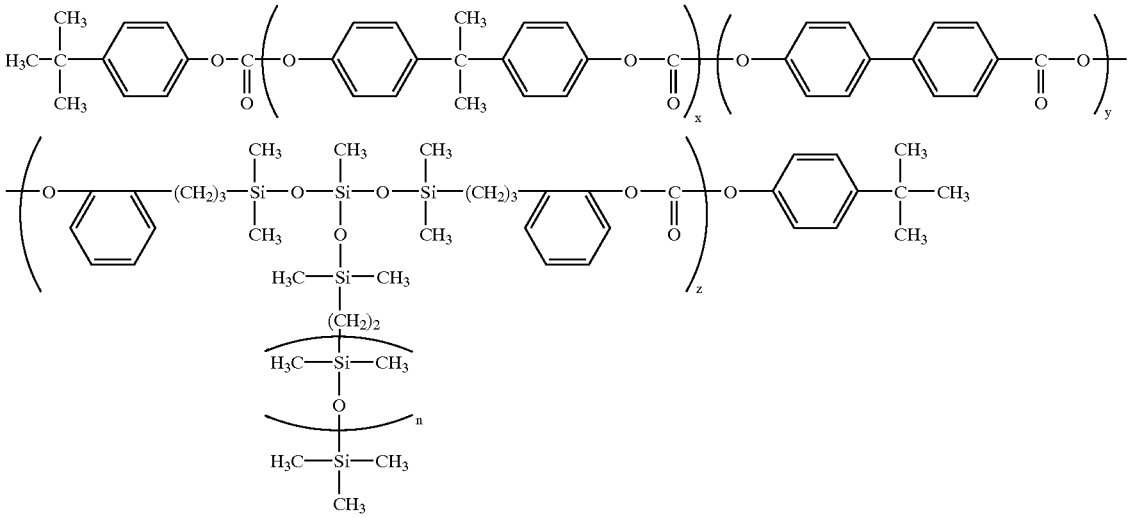

wherein, for x, y and z, the ratio of x/(x+y+z) is 0.5–0.95, and the ratio of z/(x+y+z) is 0.0001–0.1; n=0–200.

The above, and other objects, features, and advantages of the present invention will become apparent from the following description read in conjunction with the accompanying drawings, in which like reference numerals designate the same elements.

DETAILED DESCRIPTION OF THE INVENTION

Figure 1:
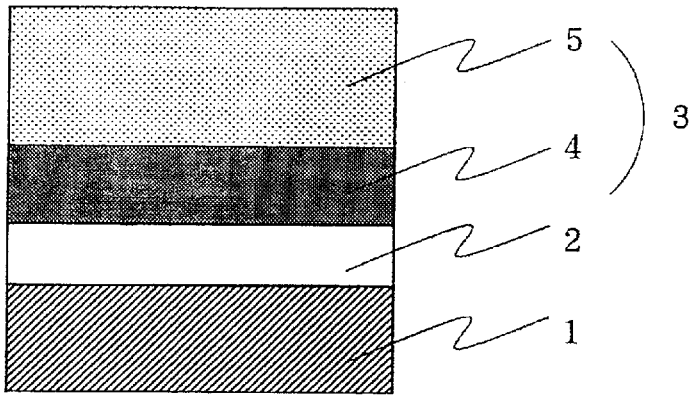
FIG. 1 is a model cross-sectional drawing showing one example of a negative charge function-separate layered electrophotography photosensitive body of the present invention.
Figure 2:
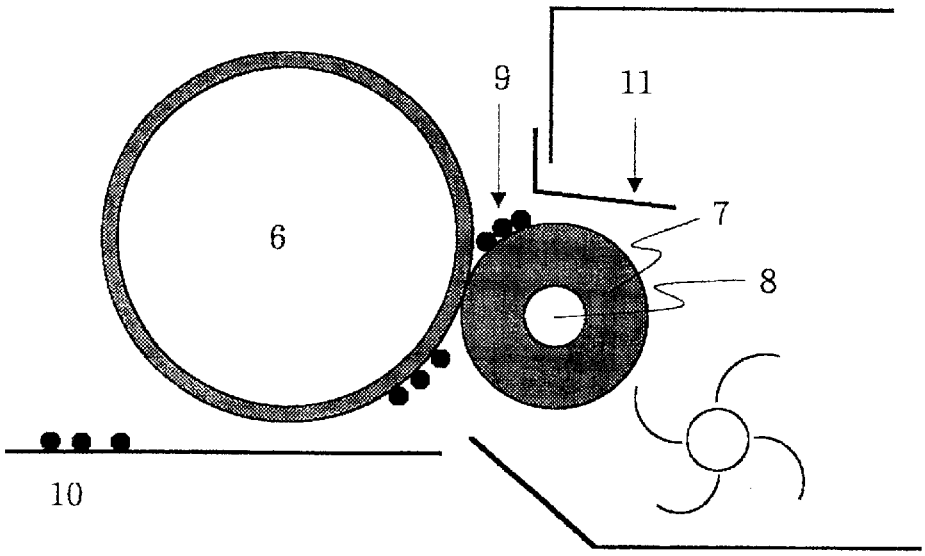
FIG. 2 is a descriptive drawing of a non-magnetic single component developing system relating to the present invention.

Referring to FIG. 1, there is a model cross-section showing one construction example of a photosensitive body relating to the present invention. This is a function separated layered photosensitive body of a negative charge type. It has a structure in which a photosensitive layer 3 is provided on top of a conductive substrate 1 via an undercoat layer 2. In photosensitive layer 3, a charge generating layer 4 and a charge transport layer 5 are sequentially layered.

Conductive substrate 1 acts as an electrode of the photosensitive body and is also the support body for each of the layers that construct the photosensitive body. Conductive substrate 1 can have the shape of a tube, sheet, or film. In terms of the materials, conductive substrate 1 can be a metal such as aluminum, stainless steel, nickel, and the like, or it can be a material in which conductive treatment is applied on top of a surface such as glass or resin and the like.

Undercoat layer 2 comprises a layer having a main component of a resin and a metal oxide coating such as aluminite and the like. Undercoat layer 2 can be provided as needed in order to control the injection of charge from the conductive substrate to the photosensitive layer, or to cover defects on the substrate surface, or to improve the adhesion of the photosensitive layer with the substrate. For the resin material used in the undercoat layer, insulated high molecular resins, such as casein, polyvinyl alcohol, polyamide, melamine, cellulose, and the like, or conductive high molecular resins such as polythiophene, polypyrrole, aniline and the like can be used. These resins can be used singly or can be used by combining and mixing as appropriate. Furthermore, these resins can also contain metal oxides such as titanium dioxide, zinc oxide, and the like.

Charge generating layer 4 is constructed from an organic charge generating material and a resin binder. For the charge generating material, phthalocyanine compounds such as metal-free phthalocyanine, titanyl phthalocyanine, and the like, pigments or dyes and the like such as various azo, quinone, indigo, cyanine, squarilium, azulenium, pyrylium compounds and the like can be used. Preferably, a tau-type metal-free phthalocyanine is used. For the resin binder, polymers and copolymers of polycarbonate, polyester, polyamide, polyurethane, epoxy, silicone, vinyl chloride, vinyl acetate, and the like can be used singly or can be combined and used. The usage amount for the charge generating material is 5–500 weight parts with respect to 10 weight parts of resin binder, and preferably is 10–100 weight parts. In addition, charge transport layer 5 is laminated at the upper part of charge generating layer 4. As a result, its film thickness is determined by the light absorption coefficient of the charge generating substance. In general, it is 5 $\mu$m or less, and preferably 1 $\mu$m or less.

Charge transport layer 5 is constructed from a charge transport material and a resin binder and is formed on the outermost surface of the photosensitive body. In the photosensitive body of the present invention, the contact angle $\theta$ of pure water on the charge transport layer must satisfy $\theta \geqq 94°$. By having the contact angle $\theta$ of pure water be 94° or greater, the surface energy of the photosensitive body surface becomes low. As a result, even when mounted onto a printer of a non-magnetic single component developing system, there is no adhesion of volatile components onto the photosensitive body surface, and a good image quality can be achieved.

For the resin binder of the charge transport layer, polycarbonate resins such as bis phenol A, bis phenol Z, bis phenol A-biphenyl copolymer, and the like, and polystyrene resin, and polyphenylene resin, and the like can be used singly or can be combined and mixed as suitable. However, preferably in the present invention, a polydialkylsiloxane-containing polycarbonate which has a repeating unit represented by the aforementioned general formula (1) is used singly, or this polydialkylsiloxane-containing polycarbonate and another polycarbonate is used at a ratio M/N>1/4, where M is the weight of this polydialkylsiloxane-containing polycarbonate and N is the weight of this other polycarbonate. It is especially preferable if this polydialkylsiloxane-containing polycarbonate is a polydialkylsiloxane-containing polycarbonate that has a repeating unit represented by the aforementioned formula (2).

For the charge transport material, a hydrazone compound, butadiene compound, diamine compound, indole compound, indoline compound, stilbene compound, distilbene compound and the like can be used individually or they can be combined and mixed as suitable. For every 100 weight parts of the resin binder, the usage amount of the charge transport material is 10–200 weight parts, and preferably 20–150 weight parts. Furthermore, in order to maintain a surface electric potential that is effective in practice, the film thickness of the charge transport layer is preferably in the range of 3–50 $\mu$m, and more suitably 15–40 $\mu$m.

Furthermore, for the undercoat layer and the charge transport layer, in order to improve sensitivity, reduce residual electric potential, or improve environmental resistance and improve stability with respect to harmful light, electron accepting substances, oxidation inhibiting agents, light stabilizing agents, and the like can be added. Compounds used for these purposes include chromanol derivatives and etherified compounds such as tocopherols and the like, esterified compounds, polyaryl alkane compounds, hydroquinone derivatives, diietherified compounds, benzophenone derivatives, benzotriazole derivatives, thioether compounds, phenylene diamine derivatives, ester phosphonate, ester phosphite, phenol compounds, hindered phenol compounds, straight chain amine compounds, annular amine compounds, hindered amine compounds, and the like. However, they are not limited to these.

Furthermore, in the photosensitive layer, for the purposes of improving the leveling of the formed film and of giving lubrication, the photosensitive layer can contain leveling agents such as silicone oil and fluorine oils, and the like.

Below, the embodiments of the present invention are described in detail.

Embodiment 1

A coating solution was prepared, in which 5 weight parts of an alcohol soluble nylon ("CM8000" manufactured by Toray Corp. Ltd.) and 5 weight parts of titanium oxide fine particles that had been treated with aminosilane were dissolved and dispersed in 90 weight parts of methanol. This coating solution was dip coated onto the outer perimeter of a conductive substrate of an aluminum tube. This was dried for 30 minutes at a temperature of 100° C., and an undercoat layer of film thickness of approximately 2 $\mu$m was formed.

A coating solution, in which 1 weight part of a charge generating material of a tau metal-free phthalocyanine and 1.5 weight parts of a resin binder of a specific vinyl chloride copolymer ("MR-110" manufactured by Nihon Zeon Corp. Ltd.) were dissolved and dispersed in 60 weight parts of dichloromethane, was prepared. This coating solution was dip coated on top of the undercoat layer. This was dried for 30 minutes at a temperature of 80° C., and a charge generating layer having a film thickness of approximately 0.3 $\mu$m was formed.

A coating solution, in which 100 weight parts of a charge transport material of a hydrazone compound ("CTC 191" manufactured by Anan Corp. Ltd.) and 100 weight parts of a resin binder of a polycarbonate resin (viscosity averaged molecular weight of 4700) having a repeating unit represented by the following formula of the present invention were dissolved in 900 weight parts of dichloromethane, was prepared.

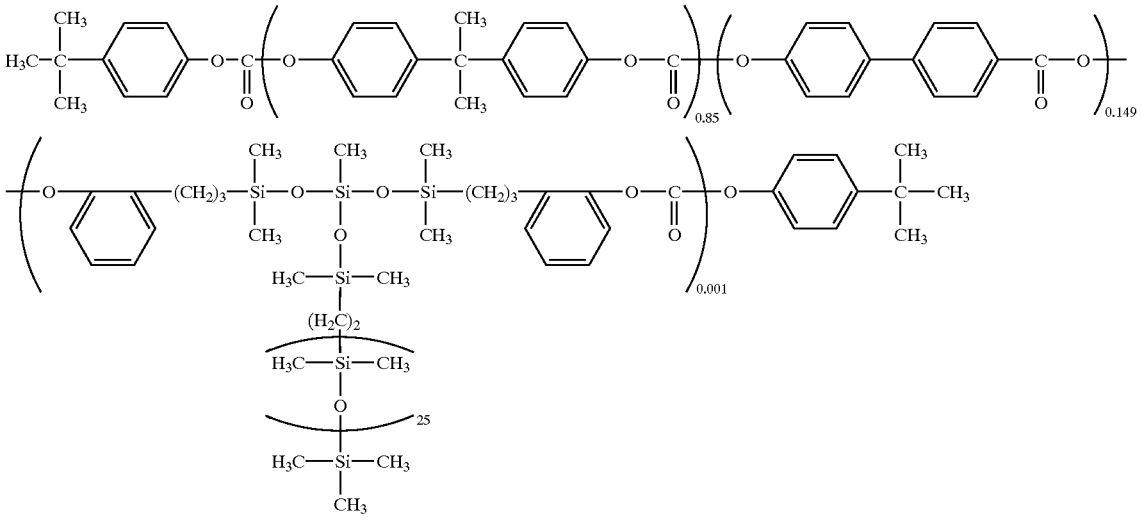

This coating solution was coated on top of this charge generating layer. This was dried for 60 minutes at a temperature of 90° C., and a charge transport layer of film thickness of approximately 25 μm was formed. The organic electrophotography photosensitive body was completed.

Embodiment 2

A photosensitive body was manufactured in the same manner as Embodiment 1, except that the charge transport layer resin binder used in Embodiment 1 was changed to 80 weight parts of polydialkyl siloxane-containing polycarbonate resin and 20 weight parts of polycarbonate resin ("TS2050" manufactured by Teijin Kasei Corp. Ltd.).

Embodiment 3

A photosensitive body was manufactured in the same manner as Embodiment 1, except that the charge transport layer resin binder used in Embodiment 1 was changed to 50 weight parts of polydialkyl siloxane-containing polycarbonate resin and 50 weight parts of polycarbonate resin ("TS2050" manufactured by Teijin Kasei Corp. Ltd.).

COMPARATIVE EXAMPLE 1

A photosensitive body was manufactured in the same manner as Embodiment 1, except that the charge transport layer resin binder used in Embodiment 1 was changed to 20 weight parts of polydialkyl siloxane-containing polycarbonate resin and 80 weight parts of polycarbonate resin ("TS2050" manufactured by Teijin Kasei Corp. Ltd.).

Embodiment 4

A photosensitive body was manufactured in the same manner as Embodiment 1, except that the charge transport layer resin binder used in Embodiment 1 was changed to 80 weight parts of polydialkyl siloxane-containing polycarbonate resin and 20 weight parts of a polycarbonate resin (viscosity averaged molecular weight 51000) having a repeating unit represented by the following formula.

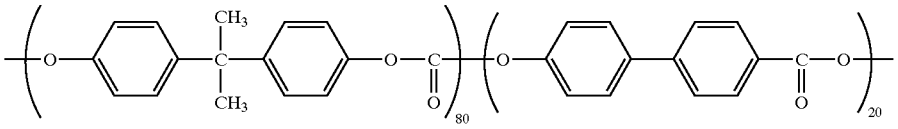

Embodiment 5

A photosensitive body was manufactured in the same manner as Embodiment 1, except that the charge transport layer resin binder used in Embodiment 1 was changed to 50 weight parts of polydialkyl siloxane-containing polycarbonate resin and 50 weight parts of a polycarbonate resin used in Embodiment 4.

COMPARATIVE EXAMPLE 2

A photosensitive body was manufactured in the same manner as Embodiment 1, except that the charge transport layer resin binder used in Embodiment 1 was changed to 20 weight parts of polydialkyl siloxane-containing polycarbonate resin and 80 weight parts of a polycarbonate resin used in Embodiment 4.

Embodiment 6

A photosensitive body was manufactured in the same manner as Embodiment 1, except that the charge transport layer resin binder used in Embodiment 1 was changed to 80 weight parts of polydialkyl siloxane-containing polycarbonate resin and 20 weight parts of polycarbonate resin ("Panlite K-1300" manufactured by Teijin Kasei Corp. Ltd.).

Embodiment 7

A photosensitive body was manufactured in the same manner as Embodiment 1, except that the charge transport layer resin binder used in Embodiment 1 was changed to 50 weight parts of polydialkyl siloxane-containing polycarbonate resin and 50 weight parts of polycarbonate resin ("Panlite K-1300" manufactured by Teijin Kasei Corp. Ltd.).

COMPARATIVE EXAMPLE 3

A photosensitive body was manufactured in the same manner as Embodiment 1, except that the charge transport layer resin binder used in Embodiment 1 was changed to 20 weight parts of polydialkyl siloxane-containing polycarbonate resin and 80 weight parts of polycarbonate resin ("Panlite K-1300" manufactured by Teijin Kasei Corp. Ltd.).

Embodiment 8

An organic electrophotography photosensitive body was manufactured in the same manner as Embodiment 1, except that the charge transport material used in Embodiment 1 was changed to a compound represented by the following formula.

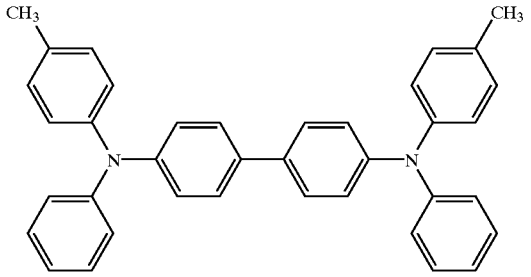

Embodiment 9

A photosensitive body was manufactured in the same manner as Embodiment 8, except that the charge transport layer resin binder used in Embodiment 8 was changed to 80 weight parts of polydialkyl siloxane-containing polycarbonate resin and 20 weight parts of polycarbonate resin ("TS2050" manufactured by Teijin Kasei Corp. Ltd.).

Embodiment 10

A photosensitive body was manufactured in the same manner as Embodiment 8, except that the charge transport layer resin binder used in Embodiment 8 was changed to 50 weight parts of polydialkyl siloxane-containing polycarbonate resin and 50 weight parts of polycarbonate resin ("TS2050" manufactured by Teijin Kasei Corp. Ltd.).

COMPARATIVE EXAMPLE 4

A photosensitive body was manufactured in the same manner as Embodiment 8, except that the charge transport layer resin binder used in Embodiment 8 was changed to 20 weight parts of polydialkyl siloxane-containing polycarbonate resin and 80 weight parts of polycarbonate resin ("TS2050" manufactured by Teijin Kasei Corp. Ltd.).

Embodiment 11

A photosensitive body was manufactured in the same manner as Embodiment 8, except that the charge transport layer resin binder used in Embodiment 8 was changed to 80 weight parts of polydialkyl siloxane-containing polycarbonate resin and 20 weight parts of a polycarbonate resin used in Embodiment 4.

Embodiment 12

A photosensitive body was manufactured in the same manner as Embodiment 8, except that the charge transport layer resin binder used in Embodiment 8 was changed to 50 weight parts of polydialkyl siloxane-containing polycarbonate resin and 50 weight parts of a polycarbonate resin used in Embodiment 4.

COMPARATIVE EXAMPLE 5

A photosensitive body was manufactured in the same manner as Embodiment 8, except that the charge transport layer resin binder used in Embodiment 8 was changed to 20 weight parts of polydialkyl siloxane-containing polycarbonate resin and 80 weight parts of a polycarbonate resin used in Embodiment 4.

Embodiment 13

A photosensitive body was manufactured in the same manner as Embodiment 8, except that the charge transport layer resin binder used in Embodiment 8 was changed to 80 weight parts of polydialkyl siloxane-containing polycarbonate resin and 20 weight parts of a polycarbonate resin ("Panlite K-1300" manufactured by Teijin Kasei Corp. Ltd.).

Embodiment 14

A photosensitive body was manufactured in the same manner as Embodiment 8, except that the charge transport layer resin binder used in Embodiment 8 was changed to 50 weight parts of polydialkyl siloxane-containing polycarbonate resin and 50 weight parts of a polycarbonate resin ("Panlite K-1300" manufactured by Teijin Kasei Corp. Ltd.).

COMPARATIVE EXAMPLE 6

A photosensitive body was manufactured in the same manner as Embodiment 8, except that the charge transport layer resin binder used in Embodiment 8 was changed to 20 weight parts of polydialkyl siloxane-containing polycarbonate resin and 80 weight parts of a polycarbonate resin ("Panlite K-1300" manufactured by Teijin Kasei Corp. Ltd.).

Embodiment 15

An organic electrophotography photosensitive body was manufactured in the same manner as Embodiment 1, except that the charge transport material used in Embodiment 1 was changed to a compound represented by the following formula.

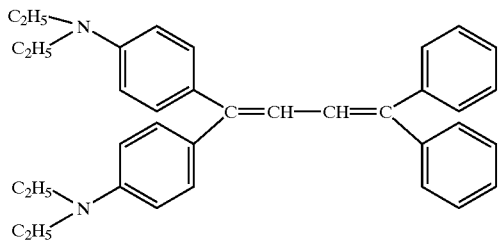

Embodiment 16

A photosensitive body was manufactured in the same manner as Embodiment 15, except that the charge transport layer resin binder used in Embodiment 15 was changed to 80 weight parts of polydialkyl siloxane-containing polycarbonate resin and 20 weight parts of a polycarbonate resin ("TS2050" manufactured by Teijin Kasei Corp. Ltd.).

Embodiment 17

A photosensitive body was manufactured in the same manner as Embodiment 15, except that the charge transport layer resin binder used in Embodiment 15 was changed to 50 weight parts of polydialkyl siloxane-containing polycarbonate resin and 50 weight parts of a polycarbonate resin ("TS2050" manufactured by Teijin Kasei Corp. Ltd.).

COMPARATIVE EXAMPLE 7

A photosensitive body was manufactured in the same manner as Embodiment 15, except that the charge transport layer resin binder used in Embodiment 15 was changed to 20 weight parts of polydialkyl siloxane-containing polycarbonate resin and 80 weight parts of a polycarbonate resin ("TS2050" manufactured by Teijin Kasei Corp. Ltd.).

Embodiment 18

A photosensitive body was manufactured in the same manner as Embodiment 15, except that the charge transport layer resin binder used in Embodiment 15 was changed to 80 weight parts of polydialkyl siloxane-containing polycarbonate resin and 20 weight parts of a polycarbonate resin used in Embodiment 4.

Embodiment 19

A photosensitive body was manufactured in the same manner as Embodiment 15, except that the charge transport layer resin binder used in Embodiment 15 was changed to 50 weight parts of polydialkyl siloxane-containing polycarbonate resin and 50 weight parts of a polycarbonate resin used in Embodiment 4.

COMPARATIVE EXAMPLE 8

A photosensitive body was manufactured in the same manner as Embodiment 15, except that the charge transport layer resin binder used in Embodiment 15 was changed to 20 weight parts of polydialkyl siloxane-containing polycarbonate resin and 80 weight parts of a polycarbonate resin used in Embodiment 4.

Embodiment 20

A photosensitive body was manufactured in the same manner as Embodiment 15, except that the charge transport layer resin binder used in Embodiment 15 was changed to 80 weight parts of polydialkyl siloxane-containing polycarbonate resin and 20 weight parts of a polycarbonate resin ("Panlite K-1300" manufactured by Teijin Kasei Corp. Ltd.).

Embodiment 21

A photosensitive body was manufactured in the same manner as Embodiment 15, except that the charge transport layer resin binder used in Embodiment 15 was changed to 50 weight parts of polydialkyl siloxane-containing polycarbonate resin and 50 weight parts of a polycarbonate resin ("Panlite K-1300" manufactured by Teijin Kasei Corp. Ltd.).

COMPARATIVE EXAMPLE 9

A photosensitive body was manufactured in the same manner as Embodiment 15, except that the charge transport layer resin binder used in Embodiment 15 was changed to 20 weight parts of polydialkyl siloxane-containing polycarbonate resin and 80 weight parts of a polycarbonate resin ("Panlite K-1300" manufactured by Teijin Kasei Corp. Ltd.).

Embodiment 22

An organic electrophotography photosensitive body was manufactured in the same manner as Embodiment 1, except that the charge transport material used in Embodiment 1 was changed to a compound represented by the following formula.

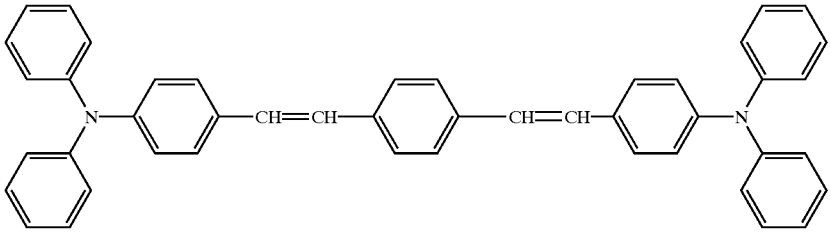

Embodiment 23

A photosensitive body was manufactured in the same manner as Embodiment 22, except that the charge transport layer resin binder used in Embodiment 22 was changed to 80 weight parts of polydialkyl siloxane-containing polycarbonate resin and 20 weight parts of a polycarbonate resin ("TS2050" manufactured by Teijin Kasei Corp. Ltd.).

Embodiment 24

A photosensitive body was manufactured in the same manner as Embodiment 22, except that the charge transport layer resin binder used in Embodiment 22 was changed to 50 weight parts of polydialkyl siloxane-containing polycarbonate resin and 50 weight parts of a polycarbonate resin ("TS2050" manufactured by Teijin Kasei Corp. Ltd.).

COMPARATIVE EXAMPLE 10

A photosensitive body was manufactured in the same manner as Embodiment 22, except that the charge transport layer resin binder used in Embodiment 22 was changed to 20 weight parts of polydialkyl siloxane-containing polycarbonate resin and 80 weight parts of a polycarbonate resin ("TS2050" manufactured by Teijin Kasei Corp. Ltd.).

Embodiment 25

A photosensitive body was manufactured in the same manner as Embodiment 22, except that the charge transport layer resin binder used in Embodiment 22 was changed to 80 weight parts of polydialkyl siloxane-containing polycarbonate resin and 20 weight parts of a polycarbonate resin used in Embodiment 4.

Embodiment 26

A photosensitive body was manufactured in the same manner as Embodiment 22, except that the charge transport layer resin binder used in Embodiment 22 was changed to 50 weight parts of polydialkyl siloxane-containing polycarbonate resin and 50 weight parts of a polycarbonate resin used in Embodiment 4.

COMPARATIVE EXAMPLE 11

A photosensitive body was manufactured in the same manner as Embodiment 22, except that the charge transport layer resin binder used in Embodiment 22 was changed to 20 weight parts of polydialkyl siloxane-containing polycarbonate resin and 80 weight parts of a polycarbonate resin used in Embodiment 4.

Embodiment 27

A photosensitive body was manufactured in the same manner as Embodiment 22, except that the charge transport layer resin binder used in Embodiment 22 was changed to 80 weight parts of polydialkyl siloxane-containing polycarbonate resin and 20 weight parts of a polycarbonate resin ("Panlite K-1300" manufactured by Teijin Kasei Corp. Ltd.).

Embodiment 28

A photosensitive body was manufactured in the same manner as Embodiment 22, except that the charge transport layer resin binder used in Embodiment 22 was changed to 50 weight parts of polydialkyl siloxane-containing polycarbonate resin and 50 weight parts of a polycarbonate resin ("Panlite K-1300" manufactured by Teijin Kasei Corp. Ltd.).

COMPARATIVE EXAMPLE 12

A photosensitive body was manufactured in the same manner as Embodiment 22, except that the charge transport layer resin binder used in Embodiment 22 was changed to 20 weight parts of polydialkyl siloxane-containing polycarbonate resin and 80 weight parts of a polycarbonate resin ("Panlite K-1300" manufactured by Teijin Kasei Corp. Ltd.).

COMPARATIVE EXAMPLE 13

A photosensitive body was manufactured in the same manner as Embodiment 1, except that the charge transport layer resin binder used in Embodiment 1 was changed to 100 weight parts of a polycarbonate resin ("TS2050" manufactured by Teijin Kasei Corp. Ltd.).

COMPARATIVE EXAMPLE 14

A photosensitive body was manufactured in the same manner as Embodiment 1, except that the charge transport layer resin binder used in Embodiment 1 was changed to 100 weight parts of a polycarbonate resin used in Embodiment 4.

COMPARATIVE EXAMPLE 15

A photosensitive body was manufactured in the same manner as Embodiment 1, except that the charge transport layer resin binder used in Embodiment 1 was changed to 100 weight parts of a polycarbonate resin ("Panlite K-1300" manufactured by Teijin Kasei Corp. Ltd.).

COMPARATIVE EXAMPLE 16

A photosensitive body was manufactured in the same manner as Embodiment 8, except that the charge transport layer resin binder used in Embodiment 8 was changed to 100 weight parts of a polycarbonate resin ("TS2050" manufactured by Teijin Kasei Corp. Ltd.).

COMPARATIVE EXAMPLE 17

A photosensitive body was manufactured in the same manner as Embodiment 8, except that the charge transport layer resin binder used in Embodiment 8 was changed to 100 weight parts of a polycarbonate resin used in Embodiment 4.

COMPARATIVE EXAMPLE 18

A photosensitive body was manufactured in the same manner as Embodiment 8, except that the charge transport layer resin binder used in Embodiment 8 was changed to 100 weight parts of a polycarbonate resin ("Panlite K-1300" manufactured by Teijin Kasei Corp. Ltd.).

COMPARATIVE EXAMPLE 19

A photosensitive body was manufactured in the same manner as Embodiment 15, except that the charge transport layer resin binder used in Embodiment 15 was changed to 100 weight parts of a polycarbonate resin ("TS2050" manufactured by Teijin Kasei Corp. Ltd.).

COMPARATIVE EXAMPLE 20

A photosensitive body was manufactured in the same manner as Embodiment 15, except that the charge transport layer resin binder used in Embodiment 15 was changed to 100 weight parts of a polycarbonate resin used in Embodiment 4.

COMPARATIVE EXAMPLE 21

A photosensitive body was manufactured in the same manner as Embodiment 15, except that the charge transport layer resin binder used in Embodiment 15 was changed to 100 weight parts of a polycarbonate resin ("Panlite K-1300" manufactured by Teijin Kasei Corp. Ltd.).

COMPARATIVE EXAMPLE 22

A photosensitive body was manufactured in the same manner as Embodiment 22, except that the charge transport layer resin binder used in Embodiment 22 was changed to 100 weight parts of a polycarbonate resin ("TS2050" manufactured by Teijin Kasei Corp. Ltd.).

COMPARATIVE EXAMPLE 23

A photosensitive body was manufactured in the same manner as Embodiment 22, except that the charge transport layer resin binder used in Embodiment 22 was changed to 100 weight parts of a polycarbonate resin used in Embodiment 4.

COMPARATIVE EXAMPLE 24

A photosensitive body was manufactured in the same manner as Embodiment 22, except that the charge transport layer resin binder used in Embodiment 22 was changed to 100 weight parts of a polycarbonate resin ("Panlite K-1300" manufactured by Teijin Kasei Corp. Ltd.).

Evaluation of the Photosensitive Body (1) Measurement of the contact angle

The reason that volatile components from the developing roller adheres to the photosensitive body surface is believed to be because the high surface energy of the photosensitive body. Based on this idea, the contact angle θ of pure water, which is correlated with the surface energy, is used as a substitute, and evaluation was conducted with this value (when the contact angle theta of pure water becomes small, the surface energy becomes large).

The measurement samples were the photosensitive bodies manufactured in Embodiments 1–28 and Comparative examples 1–24. For the measurement device, a roll material contact angle measurement device CA-S Roll type (manufactured by Kyowa Kaimen Kagaku Corp. Ltd.) was used. For the measurement method, first, pure water was placed inside a cylinder. A specified liquid drop was dripped onto the photosensitive body drum. The contact angle was measured by a finder scope.

(2) Test of surface contamination of the photosensitive body by the developing roller under a high temperature/high humidity environment With the photosensitive bodies manufactured in Embodiments 1–28 and Comparative examples 1–24, a test of surface contamination of the photosensitive body by the developing roller was conducted. First, two types of developing rollers (silicon rubber and acrylonitrile-butadiene rubber (abbreviated as NBR)) were placed in contact with the photosensitive body and pressed together and fastened with a rubber band (commercial product). Next, this was left for 30 hours in a high temperature/high humidity environment (temperature 55° C., humidity 85%). Afterwards, the section where the photosensitive body surface was in contact was visually inspected, and a printed image evaluation (half-tone image) was conducted.

Referring to Tables 1–4, evaluation results from the above (1) and (2) are summarized and shown. Tables 1 and 2 show when the developing roller was a silicon rubber, and Tables 3 and 4 show when the developing roller was NBR.

TABLE 1

| Photosensitive body sample | Contact angle θ | Contamination test results: Surface inspection results | Contamination test results: Printing results |
|---|---|---|---|
| Embodiment 1 | 96 | No adhesion substances | No voids on halftone image |
| Embodiment 2 | 95.2 | No adhesion substances | No voids on halftone image |
| Embodiment 3 | 94.3 | No adhesion substances | No voids on halftone image |
| Comparative example 1 | 93.8 | Adhesion substances seen | Voids seen on halftone image |
| Embodiment 4 | 95.7 | No adhesion substances | No voids on halftone image |
| Embodiment 5 | 94.5 | No adhesion substances | No voids on halftone image |
| Comparative example 2 | 93.7 | Adhesion substances seen | Voids seen on halftone image |
| Embodiment 6 | 96 | No adhesion substances | No voids on halftone image |
| Embodiment 7 | 94.4 | No adhesion substances | No voids on halftone image |
| Comparative example 3 | 93.8 | Adhesion substances seen | Voids seen on halftone image |
| Embodiment 8 | 95.8 | No adhesion substances | No voids on halftone image |
| Embodiment 9 | 95.2 | No adhesion substances | No voids on halftone image |
| Embodiment 10 | 94.3 | No adhesion substances | No voids on halftone image |
| Comparative example 4 | 93.8 | Adhesion substances seen | Voids seen on halftone image |
| Embodiment 11 | 95.7 | No adhesion substances | No voids on halftone image |
| Embodiment 12 | 94.5 | No adhesion substances | No voids on halftone image |
| Comparative example 5 | 93.7 | Adhesion substances seen | Voids seen on halftone image |
| Embodiment 13 | 96 | No adhesion substances | No voids on halftone image |
| Embodiment 14 | 94.4 | No adhesion substances | No voids on halftone image |
| Comparative example 6 | 93.8 | Adhesion substances seen | Voids seen on halftone image |
| Embodiment 15 | 96 | No adhesion substances | No voids on halftone image |
| Embodiment 16 | 95.4 | No adhesion substances | No voids on halftone image |
| Embodiment 17 | 94.3 | No adhesion substances | No voids on halftone image |
| Comparative example 7 | 93.8 | Adhesion substances seen | Voids seen on halftone image |
| Embodiment 18 | 95.7 | No adhesion substances | No voids on halftone image |
| Embodiment 19 | 94.6 | No adhesion substances | No voids on halftone image |

TABLE 2

| Photosensitive body sample | Contact angle θ | Contamination test results: Surface inspection results | Contamination test results: Printing results |
|---|---|---|---|
| Comparative example 8 | 93.7 | Adhesion substances seen | Voids seen on halftone image |
| Embodiment 20 | 95.8 | No adhesion substances | No voids on halftone image |
| Embodiment 21 | 94.4 | No adhesion substances | No voids on halftone image |
| Comparative example 9 | 93.8 | Adhesion substances seen | Voids seen on halftone image |
| Embodiment 22 | 95.9 | No adhesion substances | No voids on halftone image |
| Embodiment 23 | 95.1 | No adhesion substances | No voids on halftone image |
| Embodiment 24 | 94.4 | No adhesion substances | No voids on halftone image |
| Comparative example 10 | 93.8 | Adhesion substances seen | Voids seen on halftone image |
| Embodiment 25 | 95.7 | No adhesion substances | No voids on halftone image |
| Embodiment 26 | 94.5 | No adhesion substances | No voids on halftone image |
| Comparative example 11 | 93.4 | Adhesion substances seen | Voids seen on halftone image |
| Embodiment 27 | 96 | No adhesion substances | No voids on halftone image |
| Embodiment 28 | 95.2 | No adhesion substances | No voids on halftone image |
| Comparative example 12 | 93.8 | Adhesion substances seen | Voids seen on halftone image |
| Comparative example 13 | 92.6 | Adhesion substances seen | Voids seen on halftone image |
| Comparative example 14 | 92.3 | Adhesion substances seen | Voids seen on halftone image |

TABLE 2-continued

| Photosensitive body sample | Contact angle θ | Contamination test results: Surface inspection results | Contamination test results: Printing results |
|---|---|---|---|
| Comparative example 15 | 92.4 | Adhesion substances seen | Voids seen on halftone image |
| Comparative example 16 | 92.5 | Adhesion substances seen | Voids seen on halftone image |
| Comparative example 17 | 92.4 | Adhesion substances seen | Voids seen on halftone image |
| Comparative example 18 | 92.4 | Adhesion substances seen | Voids seen on halftone image |
| Comparative example 19 | 92.5 | Adhesion substances seen | Voids seen on halftone image |
| Comparative example 20 | 92.6 | Adhesion substances seen | Voids seen on halftone image |
| Comparative example 21 | 92.4 | Adhesion substances seen | Voids seen on halftone image |
| Comparative example 22 | 92.5 | Adhesion substances seen | Voids seen on halftone image |
| Comparative example 23 | 92.5 | Adhesion substances seen | Voids seen on halftone image |
| Comparative example 24 | 92.7 | Adhesion substances seen | Voids seen on halftone image |

TABLE 3

| Photosensitive body sample | Contact angle θ | Contamination test results: Surface inspection results | Contamination test results: Printing results |
|---|---|---|---|
| Embodiment 1 | 96 | No adhesion substances | No voids on halftone image |
| Embodiment 2 | 95.2 | No adhesion substances | No voids on halftone image |
| Embodiment 3 | 94.3 | No adhesion substances | No voids on halftone image |
| Comparative example 1 | 93.8 | Adhesion substances seen | Voids seen on halftone image |
| Embodiment 4 | 95.7 | No adhesion substances | No voids on halftone image |
| Embodiment 5 | 94.5 | No adhesion substances | No voids on halftone image |
| Comparative example 2 | 93.7 | Adhesion substances seen | Voids seen on halftone image |
| Embodiment 6 | 96 | No adhesion substances | No voids on halftone image |
| Embodiment 7 | 94.4 | No adhesion substances | No voids on halftone image |
| Comparative example 3 | 93.8 | Adhesion substances seen | Voids seen on halftone image |
| Embodiment 8 | 95.8 | No adhesion substances | No voids on halftone image |
| Embodiment 9 | 95.2 | No adhesion substances | No voids on halftone image |
| Embodiment 10 | 94.3 | No adhesion substances | No voids on halftone image |
| Comparative example 4 | 93.8 | Adhesion substances seen | Voids seen on halftone image |
| Embodiment 11 | 95.7 | No adhesion substances | No voids on halftone image |
| Embodiment 12 | 94.5 | No adhesion substances | No voids on halftone image |
| Comparative example 5 | 93.7 | Adhesion substances seen | Voids seen on halftone image |
| Embodiment 13 | 96 | No adhesion substances | No voids on halftone image |
| Embodiment 14 | 94.4 | No adhesion substances | No voids on halftone image |
| Comparative example 6 | 93.8 | Adhesion substances seen | Voids seen on halftone image |
| Embodiment 15 | 96 | No adhesion substances | No voids on halftone image |
| Embodiment 16 | 95.4 | No adhesion substances | No voids on halftone image |
| Embodiment 17 | 94.3 | No adhesion substances | No voids on halftone image |
| Comparative example 7 | 93.8 | Adhesion substances seen | Voids seen on halftone image |
| Embodiment 18 | 95.7 | No adhesion substances | No voids on halftone image |
| Embodiment 19 | 94.6 | No adhesion substances | No voids on halftone image |

TABLE 4

| Photosensitive body sample | Contact angle θ | Contamination test results: Surface inspection results | Contamination test results: Printing results |
|---|---|---|---|
| Comparative example 8 | 93.7 | Adhesion substances seen | Voids seen on halftone image |
| Embodiment 20 | 95.8 | No adhesion substances | No voids on halftone image |
| Embodiment 21 | 94.4 | No adhesion substances | No voids on halftone image |
| Comparative example 9 | 93.8 | Adhesion substances seen | Voids seen on halftone image |
| Embodiment 22 | 95.9 | No adhesion substances | No voids on halftone image |
| Embodiment 23 | 95.1 | No adhesion substances | No voids on halftone image |
| Embodiment 24 | 94.4 | No adhesion substances | No voids on halftone image |
| Comparative example 10 | 93.8 | Adhesion substances seen | Voids seen on halftone image |
| Embodiment 25 | 95.7 | No adhesion substances | No voids on halftone image |
| Embodiment 26 | 94.5 | No adhesion substances | No voids on halftone image |
| Comparative example 11 | 93.4 | Adhesion substances seen | Voids seen on halftone image |
| Embodiment 27 | 96 | No adhesion substances | No voids on halftone image |
| Embodiment 28 | 95.2 | No adhesion substances | No voids on halftone image |
| Comparative example 12 | 93.8 | Adhesion substances seen | Voids seen on halftone image |
| Comparative example 13 | 92.6 | Adhesion substances seen | Voids seen on halftone image |
| Comparative example 14 | 92.3 | Adhesion substances seen | Voids seen on halftone image |
| Comparative example 15 | 92.4 | Adhesion substances seen | Voids seen on halftone image |
| Comparative example 16 | 92.5 | Adhesion substances seen | Voids seen on halftone image |
| Comparative example 17 | 92.4 | Adhesion substances seen | Voids seen on halftone image |
| Comparative example 18 | 92.4 | Adhesion substances seen | Voids seen on halftone image |

TABLE 4-continued

| Photosensitive body sample | Contact angle θ | Contamination test results: Surface inspection results | Contamination test results: Printing results |
|---|---|---|---|
| Comparative example 19 | 92.5 | Adhesion substances seen | Voids seen on halftone image |
| Comparative example 20 | 92.6 | Adhesion substances seen | Voids seen on halftone image |
| Comparative example 21 | 92.4 | Adhesion substances seen | Voids seen on halftone image |
| Comparative example 22 | 92.5 | Adhesion substances seen | Voids seen on halftone image |
| Comparative example 23 | 92.5 | Adhesion substances seen | Voids seen on halftone image |
| Comparative example 24 | 92.7 | Adhesion substances seen | Voids seen on halftone image |

As shown in the above Tables 1–4, from the results of photosensitive body surface contamination test by developing rollers of silicon rubber or NBR, when polydialkyl siloxane-containing polycarbonate was used alone, no foreign adhesion substances were seen, irregardless of the charge transport material. In addition, when the charge transport layer was constructed from a mixture of a polydialkyl siloxane-containing polycarbonate and another polycarbonate, when the ratio of M/N>1/4 (where M is the weight of the polydialkyl siloxane-containing polycarbonate and N is the weight of the other polycarbonate), there were no foreign adhesion substances, but when M/N<=1/4, foreign adhesion substances were seen. From this, it can be concluded that if M/N>1/4, no foreign substances will adhere. The contact angle theta with this was θ<94°. On average, with samples having a contact angle theta >=94 degrees, no foreign adhesion was seen on the surface of the photosensitive body, and there were no problems with the printed image quality.

The function-separated organic electrophotography photosensitive body of the present invention uses a polydialkyl siloxane-containing polycarbonate as a resin binder in the charge transport layer. When this photosensitive body is used with a printer using a non-magnetic single component developing system, there is no contamination from the developing roller, and an excellent image quality is provided.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A printer comprising:

an electrophotography photosensitive body, the electrophotography photosensative body comprising:

a conductive substrate;

a charge generating layer and a charge transport layer on top of said conductive substrate; and a contact angle, Θ, of pure water on said charge transport layer that satisfies the equation Θ>=94°; and a non-magnetic single component developing system, the non-magnetic single component developing system comprising a developing roller, the developing roller comprising a dielectric rubber material.

2. An electrophotography photosensitive body as described in claim 1, wherein:

said charge transport layer contains at least one of a resin binder of a polydialkyl siloxane-containing polycarbonate having a repeating unit represented by a following general formula (1)

(1)

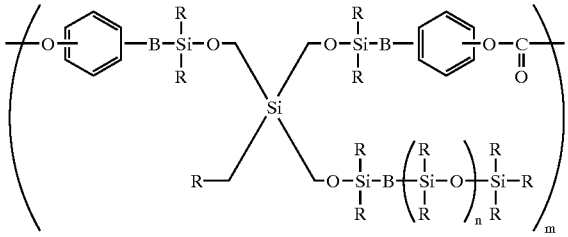

wherein each R is independently a $C_1$–$C_6$ alkyl group or an optionally substituted $C_6$–$C_{12}$ aromatic hydrocarbon group; B is $(CH_2)_x$; x is an integer from 2–6; n is from 0–200; m from 1–50, and another polycarbonate such that, with a weight M of said polydialkyl siloxane-containing polycarbonate and a weight N of said other polycarbonate has a ratio M/N which is greater than 1/4.

3. An electrophotography photosensitive body as described in claim 2, wherein:

said polydialkyl siloxane-containing polycarbonate has a repeating unit represented by a following formula (2), (2)

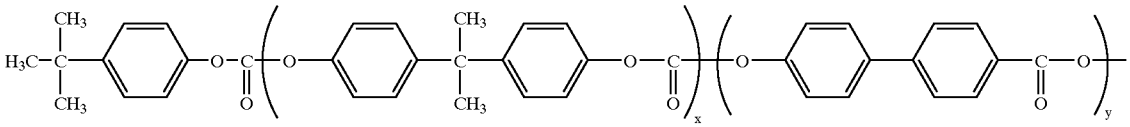

-continued
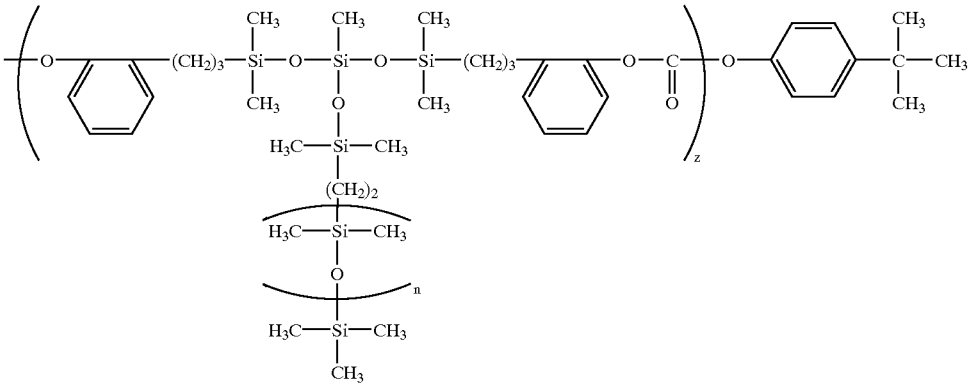
wherein, for x, y and z, a ratio of x/(x+y+z) is 0.5–0.95, and a ratio of z/(x+y+z) is 0.0001–0.1; n=0–200.
* * * * *